US010531222B2

(12) United States Patent
Tsingos

(10) Patent No.: US 10,531,222 B2
(45) Date of Patent: Jan. 7, 2020

(54) ACTIVE ACOUSTICS CONTROL FOR NEAR- AND FAR-FIELD SOUNDS

(71) Applicant: Dolby Laboratories Licensing Corporation, San Francisco, CA (US)

(72) Inventor: Nicolas R. Tsingos, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/162,895

(22) Filed: Oct. 17, 2018

(65) Prior Publication Data

US 2019/0116450 A1 Apr. 18, 2019

Related U.S. Application Data

(60) Provisional application No. 62/574,076, filed on Oct. 18, 2017.

(51) Int. Cl.
*H04S 7/00* (2006.01)
*G10L 21/0232* (2013.01)
(Continued)

(52) U.S. Cl.
CPC ..... *H04S 7/307* (2013.01); *G10L 21/0232* (2013.01); *H04R 5/02* (2013.01);
(Continued)

(58) Field of Classification Search
None
See application file for complete search history.

(56) References Cited

U.S. PATENT DOCUMENTS 7,561,699 B2 7/2009 Jot
9,747,888 B2 8/2017 Neugebauer
(Continued)

FOREIGN PATENT DOCUMENTS

DE 102011119642 5/2013
EP 1364690 11/2003
(Continued)

OTHER PUBLICATIONS

Galindo, M. B. et al "Microphone Array Design for Spatial Audio Object Early Reflection Parametrisation from Room Impulse Responsens" 24th International Congress on Sound and Vibration, Jul. 23-27, 2017, London, pp. 1-8.
(Continued)

*Primary Examiner* — James K Mooney

(57) ABSTRACT

Some disclosed methods may involve receiving audio reproduction data, including audio objects, differentiating near-field audio objects and far-field audio objects in the audio reproduction data, and rendering the far-field audio objects into speaker feed signals for room speakers of a reproduction environment. Each speaker feed signal may correspond to at least one of the room speakers. The near-field audio objects may be rendered into speaker feed signals for near-field speakers and/or headphone speakers of the reproduction environment. Reverberant audio objects may be generated based on physical microphone data from physical microphones in the reproduction environment and from virtual microphone data that is calculated for near-field audio objects. The reverberant audio objects may be rendered into speaker feed signals for the room speakers.

26 Claims, 8 Drawing Sheets

(51) Int. Cl.

| | |
|---|---|
| ***H04R 5/02*** | (2006.01) |
| ***H04R 5/04*** | (2006.01) |
| *H04R 3/12* | (2006.01) |
| *G10L 21/0208* | (2013.01) |

(52) U.S. Cl.
CPC ..... *H04R 5/04* (2013.01); *G10L 2021/02082* (2013.01); *H04R 3/12* (2013.01); *H04S 2400/11* (2013.01)

(56) References Cited

U.S. PATENT DOCUMENTS

| | | | | |
|---|---|---|---|---|
| 2011/0040396 | A1 | 2/2011 | Kraemer | |
| 2014/0119581 | A1* | 5/2014 | Tsingos | H04S 3/008 381/300 |
| 2015/0350804 | A1 | 12/2015 | Crockett | |
| 2017/0208415 | A1 | 7/2017 | Ojala | |
| 2017/0223478 | A1 | 8/2017 | Jot | |
| 2017/0366914 | A1* | 12/2017 | Stein | H04S 3/008 |
| 2018/0020312 | A1* | 1/2018 | Visser | H04R 5/033 |

FOREIGN PATENT DOCUMENTS

| | | |
|---|---|---|
| WO | 2013/006330 | 1/2013 |
| WO | 2014/091375 | 6/2014 |

OTHER PUBLICATIONS

Galindo, Miguel Blanco, et al "Microphone Arrays for Reverberant Spatial Audio Object Capture" https://www.smpte.org/sites/default/files/users/user29811/Reverberant%20object%20poster.pdf.

Jot Jean-Marc, "Efficient Models for Reverberation and Distance Rendering in Computer Music and Virtual Audio Reality" 1997, pp. 1-8.

Coleman, P. et al "Object-Based Reverberation for Spatial Audio" Journal of the Audio Engineering Society, vol. 65, No. 1/2, Jan./Feb. 2017, pp. 6-77.

Muller-Tomfelde, Christian "Hybrid Sound Reproduction in Audio-Augmented Reality" 22nd International Conference: Virtual, Synthetic, and Entertainment Audio, Jun. 1, 2002.

De Vries, D., "Wave Field Synthesis," AES Monograph, 1999.

Pulkki, V., "Compensating Displacement of Amplitude-Panned Virtual Sources," Audio Engineering Society International Conference on Virtual Synthetic and Entertainment Audio, Jun. 1, 2002.

Tsingos, Nicolas "Pre-Computing Geometry-Based Reverberation Effects for Games" AES 35th International Conference, London, UK, Feb. 11-13, 2009, pp. 1-10.

118th MPEG Hobart Meeting Report in Australia, Apr. 3-7, 2017 University of London.

* cited by examiner

FIGURE 1A
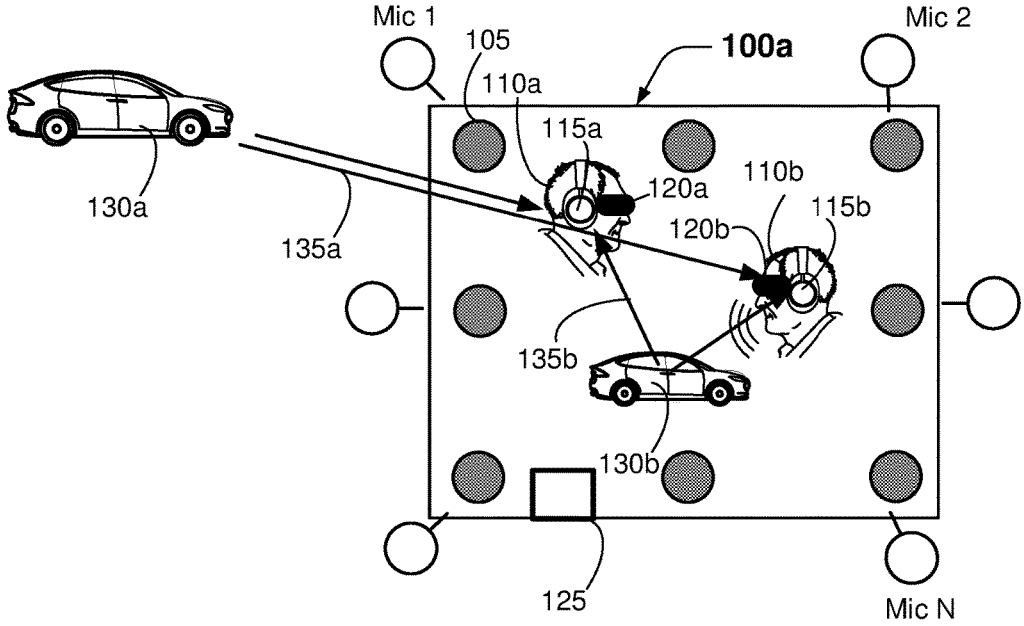
Case 1
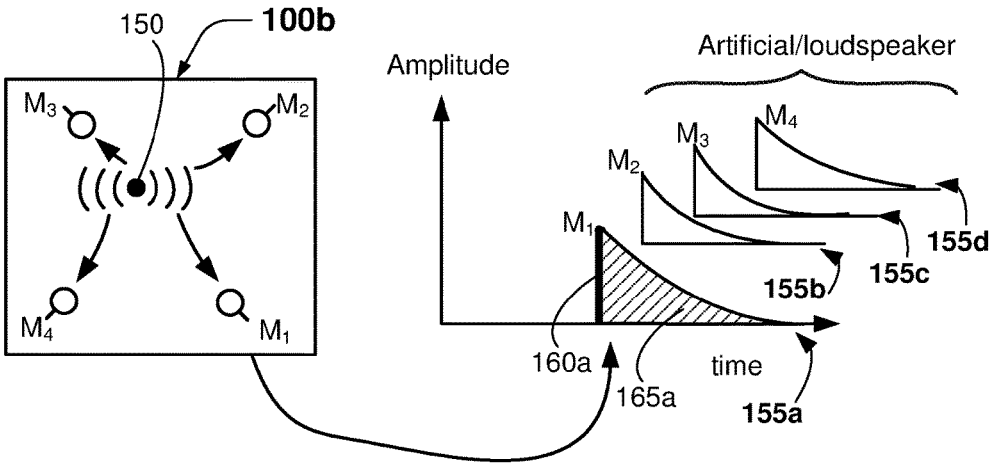
FIGURE 1B

ACTIVE ACOUSTICS CONTROL FOR NEAR- AND FAR-FIELD SOUNDS

CROSS-REFERENCE TO RELATED APPLICATION(S)

The present application claims priority to U.S. Provisional Patent Application No. 62/574,076 filed Oct. 18, 2017, which is incorporated herein by reference in its entirety.

TECHNICAL FIELD

This disclosure relates to the processing of audio signals. In particular, this disclosure relates to processing audio signals that include reverberation.

BACKGROUND

A reverberation, or reverb, is created when sound is reflected from surfaces in a local environment, such as walls, buildings, cliffs, etc. In some instances, a large number of reflections may build up and then decay as the sound is absorbed. Reverberation effects can be an important aspect of realistically presenting a virtual environment to a movie audience, to game players, etc.

SUMMARY

Various audio processing methods are disclosed herein. Some such methods may involve receiving audio reproduction data. The audio reproduction data may, in some examples, include audio objects. Some methods may involve differentiating near-field audio objects and far-field audio objects in the audio reproduction data and rendering the far-field audio objects into a first plurality of speaker feed signals for room speakers of a reproduction environment. Each speaker feed signal may correspond to at least one of the room speakers. Some implementations may involve rendering the near-field audio objects into speaker feed signals for near-field speakers and/or headphone speakers of the reproduction environment.

Some methods may involve receiving physical microphone data from a plurality of physical microphones in the reproduction environment. Some implementations may involve calculating virtual microphone data for one or more virtual microphones. The virtual microphone data may correspond to one or more of the near-field audio objects. Some methods may involve generating reverberant audio objects based, at least in part, on the physical microphone data and the virtual microphone data, and rendering the reverberant audio objects into a second plurality of speaker feed signals for the room speakers of the reproduction environment. Rendering the reverberant audio objects may, in some instances, involve applying time-varying location metadata and/or size metadata. In some examples, the physical microphone data may be based, at least in part, on sound produced by the room speakers.

According to some examples, generating the reverberant audio objects may involve applying a reverberant audio object gain. The reverberant audio object gain may, for example, be based at least in part on a distance between a room speaker location and a physical microphone location or a virtual microphone location. The reverberation process may, for example, involve applying a filter to create a frequency-dependent amplitude decay. In some examples, applying the reverberant audio object gain may involve providing a relatively lower gain for a room speaker having a closest room speaker location to the microphone location and providing relatively higher gains for room speakers having room speaker locations farther from the microphone location. Some examples may involve decorrelating the reverberant audio objects.

According to some implementations, generating the reverberant audio objects may involve making a summation of the physical microphone data and the virtual microphone data and providing the summation to a reverberation process.

Some methods may involve receiving a reverberation indication associated with the audio reproduction data and generating the reverberant audio objects based, at least in part, on the reverberation indication. According to some examples, differentiating the near-field audio objects and the far-field audio objects may involve determining a distance between a location at which an audio object is to be rendered and a location of the reproduction environment.

Some methods may involve applying a noise reduction process to at least the physical microphone data. Some implementations may involve applying a gain to at least one of the physical microphone data or the virtual microphone data.

Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, various innovative aspects of the subject matter described in this disclosure can be implemented in a non-transitory medium having software stored thereon. The software may, for example, include instructions for controlling at least one device to process audio data. The software may, for example, be executable by one or more components of a control system such as those disclosed herein.

The software may, for example, include instructions for performing one or more of the methods disclosed herein. Some such methods may involve receiving audio reproduction data. The audio reproduction data may, in some examples, include audio objects. Some methods may involve differentiating near-field audio objects and far-field audio objects in the audio reproduction data and rendering the far-field audio objects into a first plurality of speaker feed signals for room speakers of a reproduction environment. Each speaker feed signal may correspond to at least one of the room speakers. Some implementations may involve rendering the near-field audio objects into speaker feed signals for near-field speakers and/or headphone speakers of the reproduction environment.

Some methods may involve receiving physical microphone data from a plurality of physical microphones in the reproduction environment. Some implementations may involve calculating virtual microphone data for one or more virtual microphones. The virtual microphone data may correspond to one or more of the near-field audio objects. Some methods may involve generating reverberant audio objects based, at least in part, on the physical microphone data and the virtual microphone data, and rendering the reverberant audio objects into a second plurality of speaker feed signals for the room speakers of the reproduction environment. Rendering the reverberant audio objects may, in some instances, involve applying time-varying location metadata and/or size metadata. In some examples, the physical microphone data may be based, at least in part, on sound produced by the room speakers.

According to some examples, generating the reverberant audio objects may involve applying a reverberant audio object gain. The reverberant audio object gain may, for example, be based at least in part on a distance between a room speaker location and a physical microphone location or a virtual microphone location. The reverberation process may, for example, involve applying a filter to create a frequency-dependent amplitude decay. In some examples, applying the reverberant audio object gain may involve providing a relatively lower gain for a room speaker having a closest room speaker location to the microphone location and providing relatively higher gains for room speakers having room speaker locations farther from the microphone location. Some examples may involve decorrelating the reverberant audio objects.

According to some implementations, generating the reverberant audio objects may involve making a summation of the physical microphone data and the virtual microphone data and providing the summation to a reverberation process.

Some methods may involve receiving a reverberation indication associated with the audio reproduction data and generating the reverberant audio objects based, at least in part, on the reverberation indication. According to some examples, differentiating the near-field audio objects and the far-field audio objects may involve determining a distance between a location at which an audio object is to be rendered and a location of the reproduction environment.

Some methods may involve applying a noise reduction process to at least the physical microphone data. Some implementations may involve applying a gain to at least one of the physical microphone data or the virtual microphone data.

At least some aspects of the present disclosure may be implemented via apparatus. For example, one or more devices may be configured for performing, at least in part, the methods disclosed herein. In some implementations, an apparatus may include an interface system and a control system. The interface system may include one or more network interfaces, one or more interfaces between the control system and a memory system, one or more interfaces between the control system and another device and/or one or more external device interfaces. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components.

According to some such examples, the apparatus may include an interface system and a control system. The interface system may be configured for receiving audio reproduction data, which may include audio objects. The control system may, for example, be configured for differentiating near-field audio objects and far-field audio objects in the audio reproduction data and for rendering the far-field audio objects into a first plurality of speaker feed signals for room speakers of a reproduction environment. Each speaker feed signal may, for example, corresponding to at least one of the room speakers.

The control system may be configured for rendering the near-field audio objects into speaker feed signals for near-field speakers and/or headphone speakers of the reproduction environment. In some examples, the control system may be configured for receiving, via the interface system, physical microphone data from a plurality of physical microphones in the reproduction environment. In some implementations the physical microphone data may be based, at least in part, on sound produced by the room speakers. In some instances, the control system may be configured for calculating virtual microphone data for one or more virtual microphones. The virtual microphone data may correspond to one or more of the near-field audio objects.

According to some examples, the control system may be configured for generating reverberant audio objects based, at least in part, on the physical microphone data and the virtual microphone data, and for rendering the reverberant audio objects into a second plurality of speaker feed signals for the room speakers of the reproduction environment. In some implementations, generating the reverberant audio objects may involve applying a reverberant audio object gain. The reverberant audio object gain may, for example, be based at least in part on a distance between a room speaker location and a physical microphone location or a virtual microphone location.

In some examples, applying the reverberant audio object gain may involve providing a relatively lower gain for a room speaker having a closest room speaker location to the microphone location and providing relatively higher gains for room speakers having room speaker locations farther from the microphone location. According to some examples, generating the reverberant audio objects may involve making a summation of the physical microphone data and the virtual microphone data, and providing the summation to a reverberation process. In some instances, the reverberation process may involve applying a filter to create a frequency-dependent amplitude decay.

In some implementations, the control system may be configured for applying a noise reduction process to at least the physical microphone data. According to some examples, the control system may be configured for applying a gain to at least one of the physical microphone data or the virtual microphone data. In some instances, rendering the reverberant audio objects may involve applying time-varying location metadata and/or size metadata. The control system may, in some examples, be configured for decorrelating the reverberant audio objects.

According to some examples, the control system may be configured for receiving, via the interface system, a reverberation indication associated with the audio reproduction data. In some implementations, the control system may be configured for generating the reverberant audio objects based, at least in part, on the reverberation indication. The reverberation indication may, for example, indicate a reverberation that corresponds with a virtual environment of a game.

In some implementations, differentiating the near-field audio objects and the far-field audio objects may involve determining a distance between a location at which an audio object is to be rendered and a location of the reproduction environment.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

FIG. 1A shows examples of different sound sources in a reproduction environment.

FIG. 1B shows an example of creating artificial reverberation based on sounds produced by a natural sound source within a reproduction environment.

Like reference numbers and designations in the various drawings indicate like elements.

DESCRIPTION OF EXAMPLE EMBODIMENTS

Figure 2A:
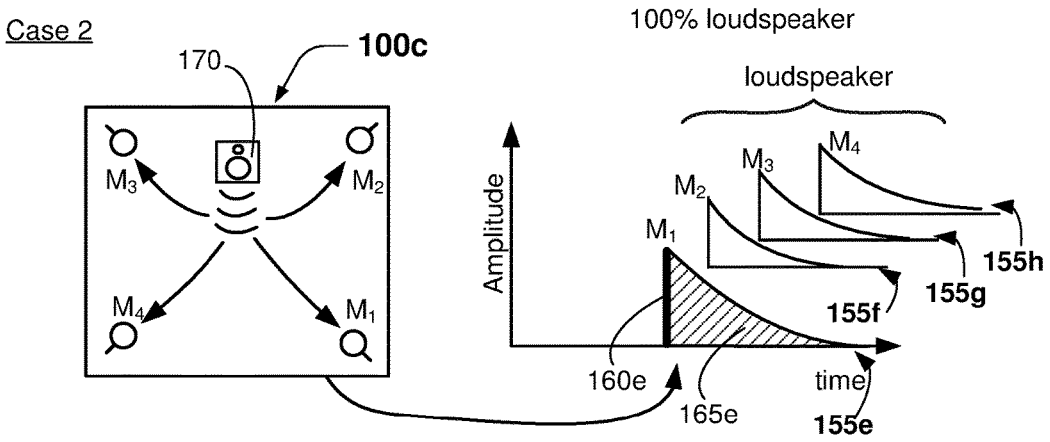
FIG. 2A shows an example of creating artificial reverberation based on sounds produced by a loudspeaker within a reproduction environment.

The following description is directed to certain implementations for the purposes of describing some innovative aspects of this disclosure, as well as examples of contexts in which these innovative aspects may be implemented. However, the teachings herein can be applied in various different ways. Moreover, the described embodiments may be implemented in a variety of hardware, software, firmware, etc. For example, aspects of the present application may be embodied, at least in part, in an apparatus, a system that includes more than one device, a method, a computer program product, etc. Accordingly, aspects of the present application may take the form of a hardware embodiment, a software embodiment (including firmware, resident software, microcodes, etc.) and/or an embodiment combining both software and hardware aspects. Such embodiments may be referred to herein as a "circuit," a "module" or "engine." Some aspects of the present application may take the form of a computer program product embodied in one or more non-transitory media having computer readable program code embodied thereon. Such non-transitory media may, for example, include a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. Accordingly, the teachings of this disclosure are not intended to be limited to the implementations shown in the figures and/or described herein, but instead have wide applicability.

FIG. 1A shows examples of different sound sources in a reproduction environment. As with other implementations shown and described herein, the numbers and kinds of elements shown in FIG. 1A are merely presented by way of example. According to this implementation, room speakers 105 are positioned in various locations of the reproduction environment 100*a*.

Here, the players 110*a* and 110*b* are wearing headphones 115*a* and 115*b*, respectively, while playing a game. According to this example, the players 110*a* and 110*b* are also wearing virtual reality (VR) headsets 120*a* and 120*b*, respectively, while playing the game. In this implementation, the audio and visual aspects of the game are being controlled by the personal computer 125. In some examples, the personal computer 125 may provide the game based, at least in part, on instructions, data, etc., received from one or more other devices, such as a game server. The personal computer 125 may include a control system and an interface system such as those described elsewhere herein.

In this example, the audio and video effects being presented for the game include audio and video representations of the cars 130*a* and 130*b*. The car 130 a is outside the reproduction environment, so the audio corresponding to the car 130*a* may be presented to the players 110*a* and 110*b* via room speakers 105. This is true in part because "far-field" sounds, such as the direct sounds 135*a* from the car 130*a*, seem to be coming from a similar direction from the perspective of the players 110*a* and 110*b*. If the car 130 a were located at a greater distance from the reproduction environment 100*a*, the direct sounds 135 a from the car 130*a* would seem, from the perspective of the players 110*a* and 110*b*, to be coming from approximately the same direction.

However, "near-field" sounds, such as the direct sounds 135*b* from the car 130*b*, cannot always be reproduced realistically by the room speakers 105. In this example, the direct sounds 135*b* from the car 130*b* appear to be coming from different directions, from the perspective of each player. Therefore, such near-field sounds may be more accurately and consistently reproduced by headphone speakers or other types of near-field speakers, such as those that may be provided on some VR headsets.

As noted above, reverberation effects can be an important aspect of realistically presenting a virtual environment to a movie audience, to game players, etc. For example, if one portion of a game is taking place in a cave, the audio provided as part of the game (which may be referred to herein as "game sounds") should reverberate to indicate the cave environment. Preferably, the voices and other sounds made by the player(s) (such as shooting sounds) should also reverberate to indicate the cave environment, in order to maintain the illusion that the players are truly in the virtual environment provided by the game.

In the example shown in FIG. 1A, the player 110*b* is talking. In order to create a consistent auditory effect, it would be preferable that the voice of player 110*b* is reverberated in substantially the same manner that far-field game sounds, such as the sounds from the car 130*a*, and in substantially the same manner that near-field game sounds, such as the sounds from the car 130*b*, are reverberated.

In order to provide realistic and consistent reverberations, some disclosed implementations provide active acoustic control of reverberation properties. In the example shown in FIG. 1A, the reproduction environment 100*a* includes N physical microphones. These physical microphones may include any suitable type of microphones known in the art, such as dynamic microphones, condenser microphones, piezoelectric microphones, etc. The physical microphones may or may not be directional microphones, depending on the particular implementation.

According to some such implementations, input from physical microphones of a reproduction environment may be used to generate reverberation effects. Three general categories of sounds for which reverberation effects may be generated will be described with reference to FIGS. 1B, 2A and 2B.

FIG. 1B shows an example of creating artificial reverberation based on sounds produced by a natural sound source within a reproduction environment. This process may be referred to herein as "Case 1." The sound source 150 may, for example, correspond to a person's voice, to non-vocal sounds produced by a person, or to other sounds. Although the term "natural" is being used to describe sound produced by the sound source 150, this term is intended to distinguish "real world" sounds from sounds reproduced by a loudspeaker. Accordingly, in some examples the "natural" sounds may be made by a machine.

In this example, the reproduction environment 100*b* includes physical microphones $M_1$-$M_4$. Graph 155*a* shows a direct natural sound 160*a* received by the physical microphone $M_1$, as well as an example of an artificial reverberation 165*a* that is based, in part, on the direct natural sound 160*a*. Accordingly, a direct sound such as the direct natural sound 160*a* may sometimes be referred to herein as a "seed" of a corresponding artificial reverberation. The artificial reverberation 165*a* may, for example, be created by a device that is configured for controlling the sounds of the reproduction environment 100*b*, such as the personal computer 125 described above.

The artificial reverberation 165*a* may be created according to any of the methods disclosed herein, or other methods known in the art. In this example, creating the artificial reverberation 165*a* involves applying a reverberation filter to create an amplitude decay, which may be a frequency-dependent amplitude decay. The reverberation filter may be defined in terms of how fast it decays, whether there is a frequency roll-off, etc. In some examples, the reverberation filter may produce artificial reverberations that are initially similar to the direct sound, but lower in amplitude and frequency-modulated. However, in other examples the reverberation filter may produce random noise that decays according to a selected decay function.

The graphs 155*b*-155*d* show examples of artificial reverberations that are based, at least in part, on direct natural sounds received by the physical microphones $M_2$-$M_4$. In some examples, each of these artificial reverberations may be reproduced by one or more speakers (not shown) of the reproduction environment. In some alternative implementations, a single artificial reverberation may be created that is based, at least in part, on the artificial reverberation 165*a* and the other artificial reverberations that are based on the sounds received by the physical microphones $M_2$-$M_4$, e.g., via summation, averaging, etc. In alternative examples, some of which are described below, a single artificial reverberation may be created that is based, at least in part, on a summation of the sounds received by the physical microphones $M_1$-$M_4$.

The reverberation filter may be selected to correspond with a particular room size, wall characteristics, etc., that a content creator wants to simulate. A frequency-dependent amplitude decay and/or a time delay between the direct natural sound 160*a* and the artificial reverberation 165*a* may, in some examples, be selected to correspond to a virtual environment that is being presented to one or more game players, television viewers, etc., in the reproduction environment 100*b*. For example, a resonant frequency and/or the time delay may be selected to correspond with a dimension of a virtual environment. In some such examples, the time delay may be selected to correspond with a two-way travel time for sound travelling from the sound source 150 to a wall, a ceiling, or another surface of the virtual environment, and back to a location within the reproduction environment 100*b*.

FIG. 2A shows an example of creating artificial reverberation based on sounds produced by a loudspeaker within a reproduction environment. This process may be referred to herein as "Case 2." The loudspeaker 170 may, in some examples, correspond to one of the room speakers of the reproduction environment 100*c*. According to some implementations, the room speakers of the reproduction environment 100*c* may be used primarily to reproduce far-field sounds and reverberations. In this example, the reproduction environment 100*c* also includes physical microphones $M_1$-$M_4$. Graph 155*e* shows a direct loudspeaker sound 160*e* received by the physical microphone $M_1$, as well as an example of an artificial reverberation 165*e* that is based, in part, on the direct loudspeaker sound 160*e*. The artificial reverberation 165*e* may, for example, be created by a device that is configured for controlling the sounds of the reproduction environment 100*c*, such as the personal computer 125 described above. The artificial reverberation 165 may be created according to any of the methods disclosed herein, or other methods known in the art.

The graphs 155*f*-155*h* show examples of artificial reverberations that are based, at least in part, on direct loudspeaker sounds received by the physical microphones $M_2$-$M_4$. In some examples, each of these artificial reverberations may be reproduced by one or more room speakers of the reproduction environment. In alternative examples, some of which are described below, a single artificial reverberation may be created that is based, at least in part, on a summation of the sounds received by the physical microphones $M_1$-$M_4$. According to some implementations, methods of controlling feedback between physical microphones and room speakers may be applied. In some such examples, the gain applied to an artificial reverberation may be based, at least in part, on the distance between a room speaker location and the physical microphone location that produced an input signal on which the artificial reverberation is based.

Figure 2B:
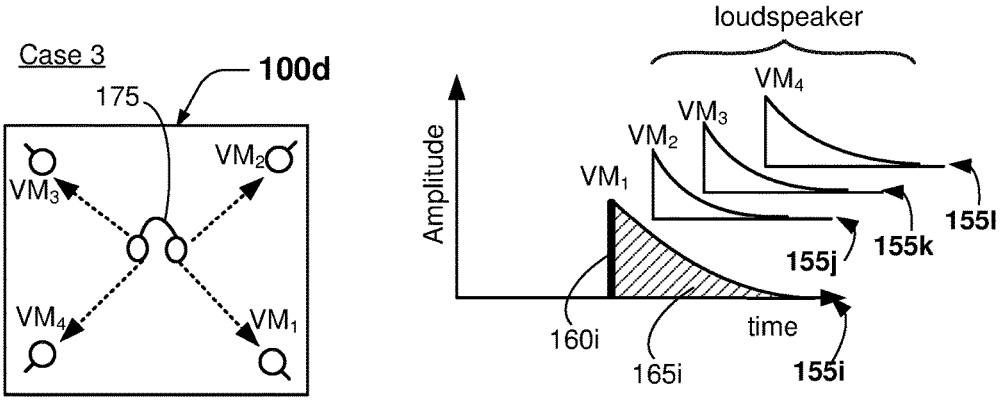
FIG. 2B shows an example of creating artificial reverberation based on sounds produced by near-field speakers within a reproduction environment.

FIG. 2B shows an example of creating artificial reverberation based on sounds produced by near-field speakers within a reproduction environment. This process may be referred to herein as "Case 3." In this example, the near-field speakers reside within a headphone device 175. In alternative implementations, the near-field speakers may be part of, or attached to, another device, such as a VR headset.

Some implementations may involve monitoring player locations and head orientations in order to provide audio to the near-field speakers in which sounds are accurately rendered according to intended sound source locations, at least with respect to direct arrival sounds. For examples, the reproduction environment 100 d may include cameras that are configured to provide image data to a personal computer or other local device. Player locations and head orientations may be determined from the image data. Alternatively, or additionally, in some implementations headsets, headphones, or other wearable gear may include one or more inertial sensor devices that are configured for providing information regarding player head orientation and/or player location.

According to some implementations, at least some sounds that are reproduced by near-field speakers, such as near-field game sounds, may not be reproduced by room speakers. Therefore, as indicated by the dashed lines in FIG. 2B, sounds that are reproduced by near-field speakers may not be picked up by physical microphones of the reproduction environment 100*d*. Accordingly, methods for producing artificial reverberations based on input from physical microphones will generally not be effective for Case 3, particularly if the sounds are being reproduced by headphone speakers.

One solution in the gaming context would be to have a game server provide near-field sounds with reverb. If, for example, a player fires an imaginary gun during the game, the gun sound would also be a near-field sound associated with the game. Preferably, the direct arrival of the gun sound should appear to come from the correct location, from the perspective of the player(s). Such near-field direct arrival sounds will be reproduced by the headphones in this example. Rendering near-field direct arrival sounds properly will depend in part on keeping track of the player locations and head orientations, at least with respect to the direct arrival/near field sounds. This could conceivably be done by a game engine, according to input regarding player locations and head orientations (e.g., according to input from one or more cameras of the reproduction environment and/or input from an inertial sensor system of headphones or a VR headset). However, there could be time delay/latency issues if the game engine is running on a game server.

As noted above, the physical microphones will not generally detect these played-back near-field sounds. When the played-back near-field sounds correspond with game sounds, the game engine (e.g., a game engine running on a game server) could provide corresponding reverb sounds. However, it would be difficult to make these reverberations consistent with the reverberations provided by an active, local, physical-microphone-based system such as described with reference to Case 1 and Case 2. In the example described above, not only would the direct arrival of the gun sound need to appear to come from the correct location, but the corresponding reverberations would also need to be consistent with those produced locally for Case 1 and Case 2.

In view of the foregoing issues, some disclosed implementations may provide consistent reverberation effects for Cases 1-3. According to some such examples, responses may be calculated for virtual microphones (VM) of a reproduction environment in Case 3 or in similar instances. The virtual microphones may or may not coincide with the number and/or the locations of physical microphones of the reproduction environment, depending on the particular implementation. However, in this example, virtual microphones $VM_1$-$VM_4$ are assumed to be located in the same positions as the physical microphones $M_1$-$M_4$.

Examples of responses that have been calculated for virtual microphones $VM_1$-$VM_4$ are shown in FIG. 2B. Graph 155*i* shows a direct sound 160*i* that is calculated to have been received by the virtual microphone $VM_1$. According to some implementations, the arrival time of the direct sound M1(*t*) will be calculated according to the distance between a virtual microphone location and the location of a near-field audio object In some examples, a gain may be calculated according to the distance between each virtual microphone location and the near-field audio object location. Some examples are described below with reference to FIG. 6.

The graph 155*i* also shows an example of an artificial reverberation 165*i* that is based, in part, on the direct sound 160*i*. The direct sound 160*i* and the artificial reverberation 165*i* may, for example, be created by a device that is configured for controlling the sounds of the reproduction environment 100*d*, such as the personal computer 125 described above. The artificial reverberation 165*i* may be created according to any of the methods disclosed herein, or other methods known in the art.

The graphs 155*j*-155*l* show examples of artificial reverberations that are based, at least in part, on direct sounds that are calculated to have been received by the virtual microphones $VM_2$-$VM_4$. In some examples, each of these artificial reverberations may be reproduced by one or more room speakers (not shown) of the reproduction environment. In alternative examples, some of which are described below, a single artificial reverberation may be created and reproduced by one or more speakers of the reproduction environment. The single artificial reverberation may, for example, be based, at least in part, on a summation of the sounds calculated to have been received by the virtual microphones $VM_1$-$VM_4$. Artificial reverberations that are reproduced by room speakers may be audible to a person using near-field speakers, such as a person using unsealed headphones.

Figure 3:
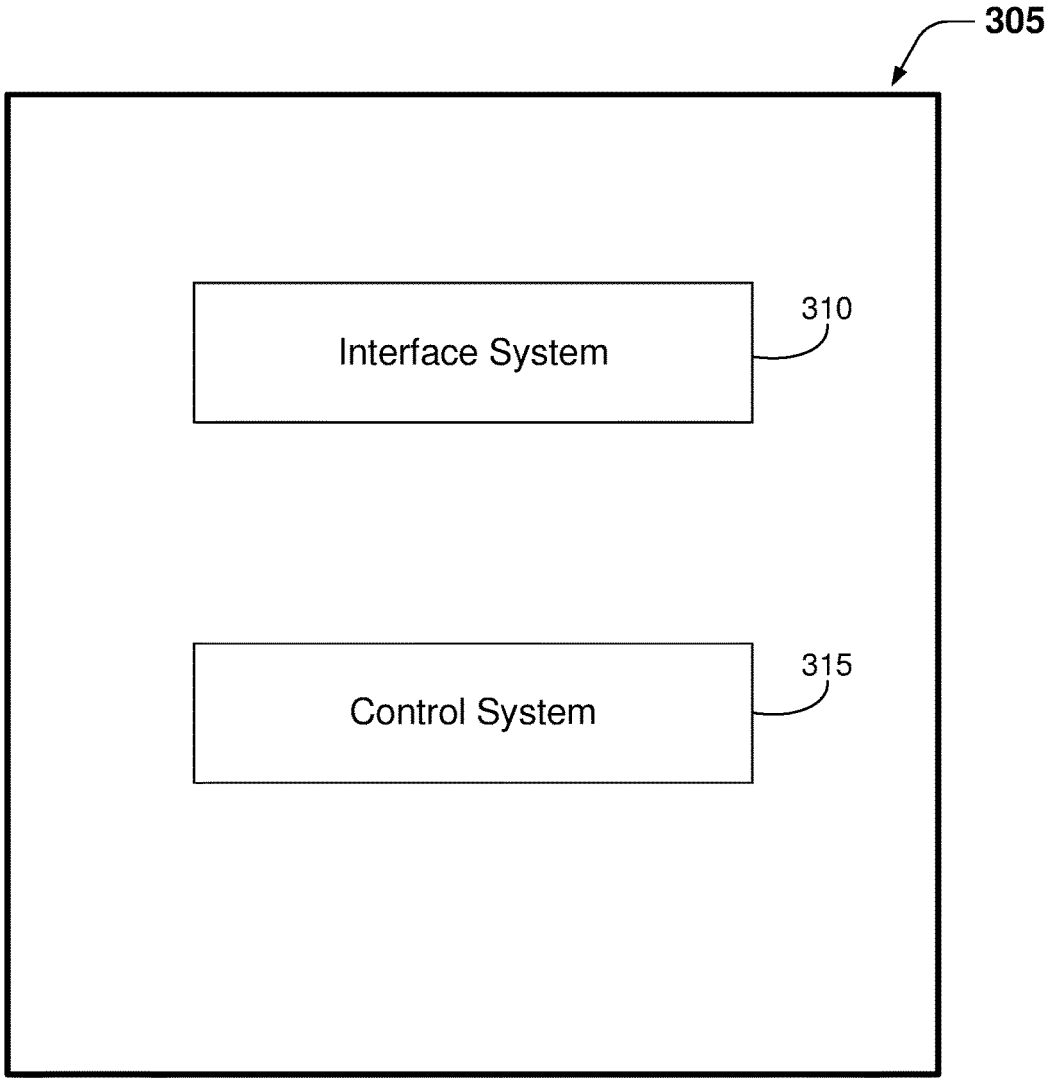
FIG. 3 is a block diagram that shows examples of components of an apparatus that may be configured to perform at least some of the methods disclosed herein.

In view of the foregoing, some aspects of the present disclosure can provide improved methods for providing artificial reverberations that correspond to near-field and far-field sounds. FIG. 3 is a block diagram that shows examples of components of an apparatus that may be configured to perform at least some of the methods disclosed herein. In some examples, the apparatus 305 may be a personal computer or other local device that is configured to provide audio processing for a reproduction environment. According to some examples, the apparatus 305 may be a client device that is configured for communication with a server, such as a game server, via a network interface. The components of the apparatus 305 may be implemented via hardware, via software stored on non-transitory media, via firmware and/or by combinations thereof. The types and numbers of components shown in FIG. 3, as well as other figures disclosed herein, are merely shown by way of example. Alternative implementations may include more, fewer and/or different components.

In this example, the apparatus 305 includes an interface system 310 and a control system 315. The interface system 310 may include one or more network interfaces, one or more interfaces between the control system 315 and a memory system and/or one or more external device interfaces (such as one or more universal serial bus (USB) interfaces). In some implementations, the interface system 310 may include a user interface system. The user interface system may be configured for receiving input from a user. In some implementations, the user interface system may be configured for providing feedback to a user. For example, the user interface system may include one or more displays with corresponding touch and/or gesture detection systems. In some examples, the user interface system may include one or more speakers. According to some examples, the user interface system may include apparatus for providing haptic feedback, such as a motor, a vibrator, etc. The control system 315 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components.

In some examples, the apparatus 305 may be implemented in a single device. However, in some implementations, the apparatus 305 may be implemented in more than one device. In some such implementations, functionality of the control system 315 may be included in more than one device. In some examples, the apparatus 305 may be a component of another device.

Figure 4:
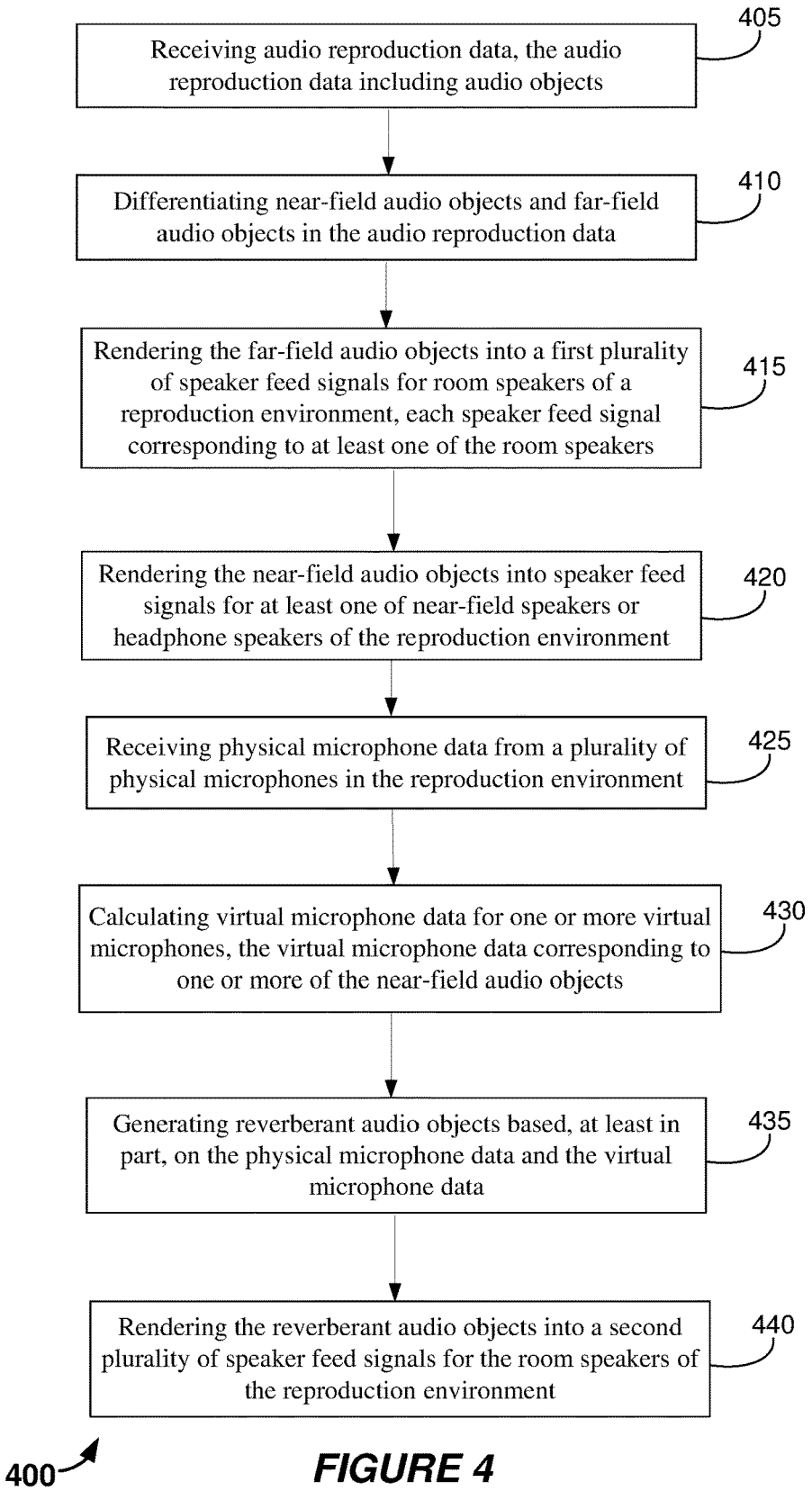
FIG. 4 is a flow diagram that outlines blocks of a method according to one example.

FIG. 4 is a flow diagram that outlines blocks of a method according to one example. The method may, in some instances, be performed by the apparatus of FIG. 3 or by another type of apparatus disclosed herein. In some examples, the blocks of method 400 may be implemented via software stored on one or more non-transitory media.

The blocks of method 400, like other methods described herein, are not necessarily performed in the order indicated. Moreover, such methods may include more or fewer blocks than shown and/or described.

In this implementation, block 405 involves receiving audio reproduction data. In this example, the audio reproduction data includes audio objects. The audio objects may include audio data and associated metadata. The metadata may, for example, include data indicating the position, size and/or trajectory of an audio object in a three-dimensional space, etc. Alternatively, or additionally, the audio reproduction data may include channel-based audio data.

According to this example, block 410 involves differentiating near-field audio objects and far-field audio objects in the audio reproduction data. Block 410 may, for example, involve differentiating the near-field audio objects and the far-field audio objects according to a distance between a location at which an audio object is to be rendered and a location of the reproduction environment. For example, block 410 may involve determining whether a location at which an audio object is to be rendered is within a predetermined first radius of a point, such as a center point, of the reproduction environment.

According to some examples, block 410 may involve determining that an audio object is to be rendered in a transitional zone between the near field and the far field. The transitional zone may, for example, correspond to a zone outside of the first radius but less than or equal to a predetermined second radius of a point, such as a center point, of the reproduction environment. In some implementations, audio objects may include metadata indicating whether an audio object is a near-field audio object, a far-field audio object or in a transitional zone between the near field and the far field. Some examples are described below with reference to FIG. 5.

In this example block 415 involves rendering the far-field audio objects into a first plurality of speaker feed signals for room speakers of a reproduction environment. Each speaker feed signal may, for example, correspond to at least one of the room speakers. According to some such implementations, block 415 may involve computing audio gains and speaker feed signals for the reproduction environment based on received audio data and associated metadata. Such audio gains and speaker feed signals may, for example, be computed according to an amplitude panning process, which can create a perception that a sound is coming from a position P in, or in the vicinity of, the reproduction environment. For example, speaker feed signals may be provided to reproduction speakers 1 through N of a reproduction environment according to the following equation:

$$x_i(t)=g_i x(t),\ i=1, \ldots N \qquad \text{(Equation 1)}$$

In Equation 1, $x_i(t)$ represents the speaker feed signal to be applied to speaker i, $g_i$ represents the gain factor of the corresponding channel, x(t) represents the audio signal and t represents time. The gain factors may be determined, for example, according to the amplitude panning methods described in Section 2, pages 3-4 of V. Pulkki, *Compensating Displacement of Amplitude-Panned Virtual Sources* (Audio Engineering Society (AES) International Conference on Virtual, Synthetic and Entertainment Audio), which is hereby incorporated by reference. In some implementations, at least some of the gains may be frequency dependent. In some implementations, a time delay may be introduced by replacing x(t) by x(t−Δt).

In this implementation, block 420 involves rendering the near-field audio objects into speaker feed signals for at least one of near-field speakers or headphone speakers of the reproduction environment. As noted above, headphone speakers may, in this disclosure, be referred to as a particular category of near-field speakers. Block 420 may proceed substantially like the rendering processes of block 415. However, block 420 also may involve determining the locations and orientations of the near-field speakers, in order to render the near-field audio objects in the proper locations from the perspective of a user whose location and head orientation may change over time. According to some examples, block 420 may involve additional processing, such as binaural or transaural processing of near-field sounds, in order to provide improved spatial audio cues.

Returning to FIG. 4, in this example block 425 involves receiving physical microphone data from a plurality of physical microphones in the reproduction environment. Some implementations may involve applying a noise reduction process to the physical microphone data. The physical microphone data may correspond to sounds produced within the reproduction environment, which may be sounds produced by game participants, other natural sounds, etc. In some examples, the physical microphone data may be based, at least in part, on sound produced by the room speakers of the reproduction environment. Accordingly, the sounds may, in some examples, correspond to Case 1 and/or Case 2 sounds as described above.

The physical microphones include any suitable type of microphones known in the art, such as dynamic microphones, condenser microphones, piezoelectric microphones, etc. The physical microphones may or may not be directional microphones, depending on the particular implementation. The number of physical microphones may vary according to the particular implementation. In some instances, block 425 may involve receiving physical microphone data from 2, 3, 4, 5, 6, 7, or 8 physical microphones. Other examples may involve receiving physical microphone data from more or fewer physical microphones.

According to this implementation, block 430 involves calculating virtual microphone data for one or more virtual microphones. The virtual microphones may or may not correspond in location or number with the physical microphones, depending on the particular implementation. In this example, the virtual microphone data corresponds to one or more of the near-field audio objects. Block 430 may correspond with calculating virtual microphone data for one or more virtual microphones according to Case 3, as described above with reference to FIG. 2B, and/or as described in one of the other examples provided herein.

According to some implementations, block 430 may involve calculating the arrival time of a direct sound, corresponding to a near-field audio object being reproduced on a near-field speaker, according to a distance between a virtual microphone location and the near-field object location. Some implementations may involve applying a gain to the physical microphone data and/or the virtual microphone data. More detailed examples are provided below.

In this example, block 435 involves generating reverberant audio objects based, at least in part, on the physical microphone data and the virtual microphone data. Various examples are disclosed herein, with some detailed examples being provided below. According to some such examples, generating the reverberant audio objects may involve making a summation of the physical microphone data and the virtual microphone data, and providing the summation to a reverberation process. Some implementations may involve decorrelating the reverberant audio objects. The reverberation process may involve applying a filter to create a frequency-dependent amplitude decay. According to some examples, each microphone signal may be convolved with a decorrelation filter (e.g., noise) and temporally shaped as a decaying signal.

Some implementations may involve generating reverberant audio objects based, at least in part, on a received reverberation indication. The reverberation indication may, for example, correspond with a movie scene, a type of virtual environment that is being presented in a game, etc. The reverberation indication may, in some examples, be one of a plurality of pre-set reverberation indications that correspond to various virtual environments, such as "cave," "closet," "bathroom," "airplane hangar," "hallway," "train station" "canyon," etc. Some such implementations may involve receiving a reverberation indication associated with received audio reproduction data and generating the reverberant audio objects based, at least in part, on the reverberation indication.

Such implementations have potential advantages. In the game context, for example, a local device (such as the personal computer 125 described above) may provide the game in a reproduction environment based, at least in part, on instructions, data, etc., received from one or more other devices, such as a game server. The game server may, for example, simply indicate what general type of reverb to provide for a particular virtual environment of a game and the local device could provide the detailed reverberation processes disclosed herein.

In some examples, generating the reverberant audio objects may involve applying a reverberant audio object gain. The reverberant audio object gain may be controlled in order to control feedback from one or more speakers and microphones, e.g., to prevent feedback from one or more speakers and microphones from becoming unstable, increasing in volume, etc. In some such examples, the reverberant audio object gain may be based, at least in part, on a distance between a room speaker location and a physical microphone location or a virtual microphone location. In some implementations, applying the reverberant audio object gain may involve providing a relatively lower gain for the closest room speaker to a microphone location and providing relatively higher gains for room speakers having locations farther from the microphone location.

Figure 5:
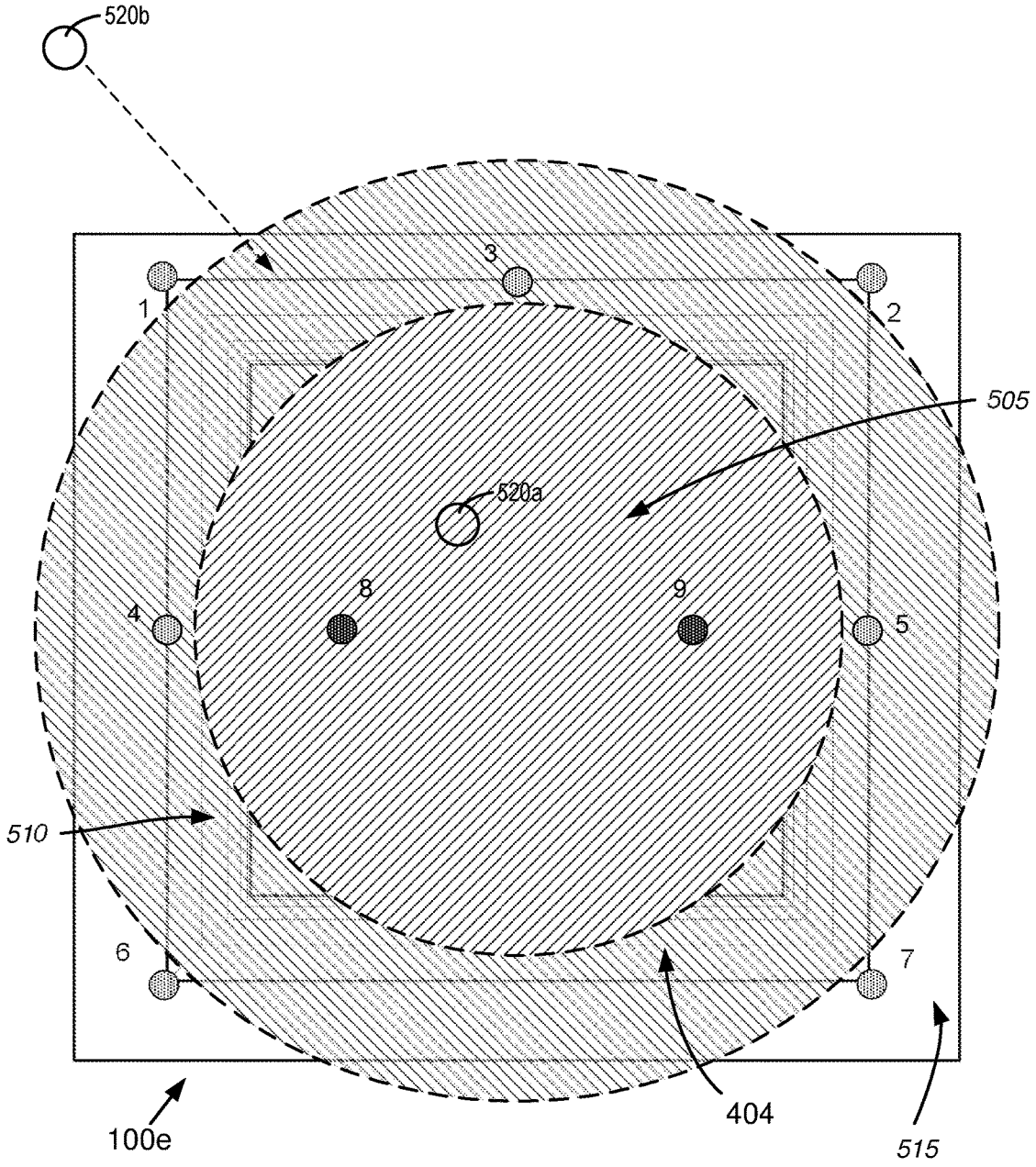
FIG. 5 shows an example of a top view of a reproduction environment.

FIG. 5 shows an example of a top view of a reproduction environment. FIG. 5 also shows examples of near-field, far-field and transitional zones of the reproduction environment 100*e*. The sizes, shapes and extent of these zones are merely made by way of example. Here, the reproduction environment 100*e* includes room speakers 1-9. In this example, near-field panning methods are applied for audio objects located within zone 505, transitional panning methods are applied for audio objects located within zone 510 and far-field panning methods are applied for audio objects located in zone 515, outside of zone 510.

According to this example, the near-field panning methods involve rendering near-field audio objects located within zone 505 (such as the audio object 520*a*) into speaker feed signals for near-field speakers, such as headphone speakers, as described elsewhere herein.

In this implementation, far-field panning methods are applied for audio objects located in zone 515, such as the audio object 520*b*. In some examples, the far-field panning methods may be based on vector-based amplitude panning (VBAP) equations that are known by those of ordinary skill in the art. For example, the far-field panning methods may be based on the VBAP equations described in Section 2.3, page 4 of V. Pulkki, Compensating Displacement of Amplitude-Panned Virtual Sources (AES International Conference on Virtual, Synthetic and Entertainment Audio), which is hereby incorporated by reference. In alternative implementations, other methods may be used for panning far-field audio objects, e.g., methods that involve the synthesis of corresponding acoustic planes or spherical waves. D. de Vries, Wave Field Synthesis (AES Monograph 1999), which is hereby incorporated by reference, describes relevant methods.

It may be desirable to blend between different panning modes as an audio object enters or leaves the virtual reproduction environment 100*e*, e.g., if the audio object 520*b* moves into zone 510 as indicated by the arrow in FIG. 5. In some examples, a blend of gains computed according to near-field panning methods and far-field panning methods may be applied for audio objects located in zone 510. In some implementations, a pair-wise panning law (e.g. an energy preserving sine or power law) may be used to blend between the gains computed according to near-field panning methods and far-field panning methods. In alternative implementations, the pair-wise panning law may be amplitude preserving rather than energy preserving, such that the sum equals one instead of the sum of the squares being equal to one. In some implementations, the audio signals may be processed by applying both near-field and far-field panning methods independently and cross-fading the two resulting audio signals.

Figure 6:
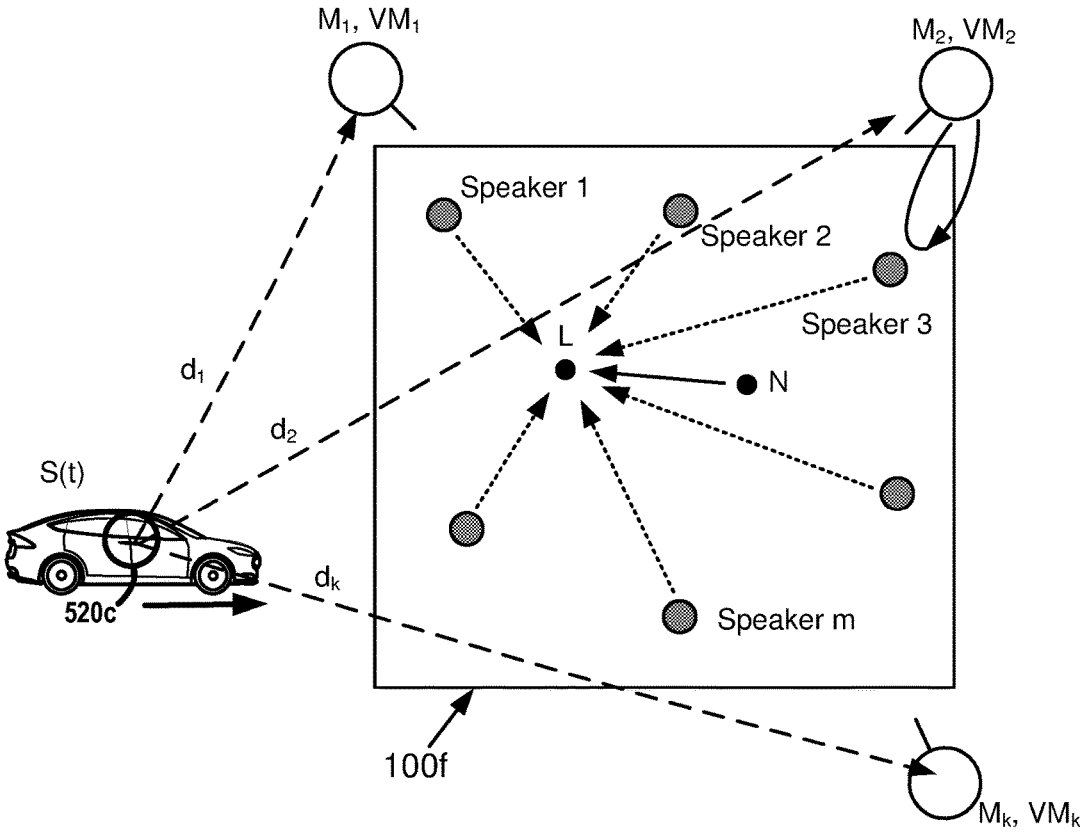
FIG. 6 shows an example of determining virtual microphone signals.

FIG. 6 shows an example of determining virtual microphone signals. In this example, the reproduction environment 100*f* includes k physical microphones and m room speakers. Although k=3 and m=6 in this example, in other examples the values of m and k may be the same, greater, or less. Here, a local device, such as a local personal computer, is configured to calculate responses for k virtual microphones that are assumed to be in the same positions as the k physical microphones. According to this example, the local device is presenting a game to a player in position L.

At the moment depicted in FIG. 6, a virtual automobile depicted by the game is close to, and approaching, the reproduction environment 100*f*. In this example, an audio object 520*c* corresponding to the virtual automobile is determined to be close enough to the reproduction environment 100*f* that transitional panning methods are applied for the audio object 520*c*. These transitional panning methods may be similar to those described above with reference audio objects located within zone 510 of FIG. 5. The sound for the audio object 520*c* may, for example, have previously been rendered only to one or more room speakers of the reproduction environment 100*f*. However, now that the audio object 520*c* is in a transitional zone, like that of zone 510, sound for the audio object 520*c* may also be rendered to speaker feed signals for near-field speakers or headphone speakers of the person at position L. Some implementations may involve cross-fading or otherwise blending the speaker feed signals for the near-field speakers or headphone speakers and speaker feed signals for the room speakers, e.g., as described above with reference to FIG. 5.

In this example, responses for the k virtual microphones will also be calculated for the audio object 520*c* now that the audio object 520*c* is in a transitional zone. In this implementation, these responses will be based, at least in part, on the audio signal S(t) that corresponds to the audio object 520*c*. In some examples, the virtual microphone data for each of the k virtual microphones may be calculated as follows:

$$\left(\frac{S\left(t-\frac{d_k}{c}\right)}{d_k}\right) \quad \text{(Equation 2)}$$

In Equation 2, $d_k$ represents the distance from the position at which an audio object is to be rendered, which is the location of the audio object 520*c* in this example, to the position of the $k^{th}$ virtual microphone. Here, c represent the speed of sound and $d_k/c$ represents a delay function corresponding to the travel time for sound from the position at which an audio object is to be rendered to the position of the $k^{th}$ virtual microphone.

In some implementations, the physical microphones of a reproduction environment may be directional microphones. Therefore, some implementations allow virtual microphone data to more closely match physical microphone data by taking into account the directionality of the physical microphones, e.g., as follows:

$$D_k * \left(\frac{S\left(t-\frac{d_k}{c}\right)}{d_k}\right) \quad \text{(Equation 3)}$$

Equation 3 is essentially Equation 2 convolved with the term $D_k$, which represents a directionality filter that corresponds to the directionality of the physical microphones. For example, if the physical microphones are cardioid microphones, $D_k$ may correspond with the polar pattern of a cardioid microphone having the orientation of a physical microphone that is co-located with a virtual microphone position.

FIG. 6 also shows a natural sound source N that is producing a sound in the reproduction environment 100*f*. As noted elsewhere herein, reverberations (which may take the form of reverberant audio objects) may be produced based on physical microphone data received from the k physical microphones in the reproduction environment 100*f* as well as virtual microphone data that is calculated for the k virtual microphones. The physical microphone data may be based, at least in part, on sounds from the natural sound source N. In this example, the reverberations are being reproduced by the m room speakers of the reproduction environment 100*f*, as indicated by the dashed lines.

Generating the reverberations may involve applying a gain that is based at least in part on a distance between a room speaker location and a physical microphone location or a virtual microphone location.

According to the example shown in FIG. 6, applying the gain involves providing a relatively lower gain for speaker feed signals for speaker 2 and speaker 3, for reverberations based on signals from physical microphone 2, and providing a relatively higher gain for speaker feed signals for speaker m for reverberations based on signals from physical microphone 2. This is one way of controlling feedback between a microphone and nearby speakers, such as the feedback loop shown between physical microphone 2 and speaker 3. Accordingly, in this example, applying the gain involves providing a relatively lower gain for a room speaker having a closest room speaker location to the microphone location and providing relatively higher gains for room speakers having room speaker locations farther from the microphone location. In addition to controlling feedback, such techniques may help to provide a more natural-sounding reverberation. Introducing some amount of mixing and/or randomness to speaker feed signals for the reverberations may also make the reverberations sound more natural.

Figure 7:
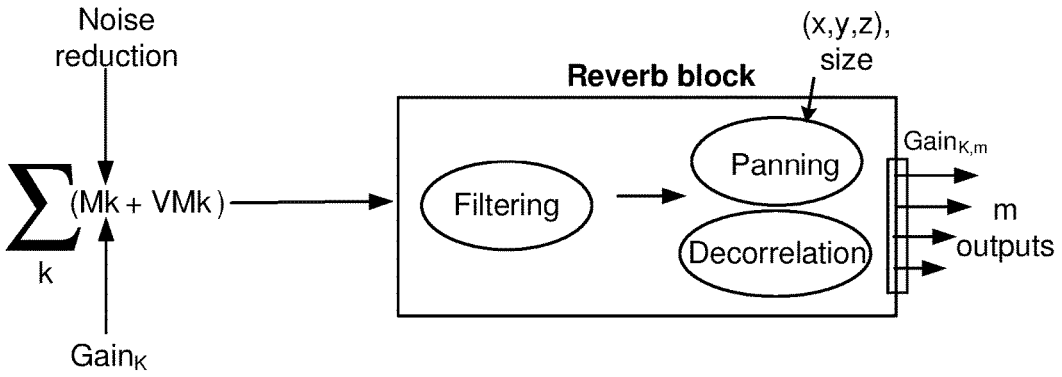
FIG. 7 illustrates an example of generating reverberant audio objects based, at least in part, on physical microphone data and virtual microphone data.

FIG. 7 illustrates an example of generating reverberant audio objects based, at least in part, on physical microphone data and virtual microphone data. The methods described with reference to FIG. 7 may, in some instances, be performed by the apparatus of FIG. 3 or by another type of apparatus disclosed herein. In some examples, methods described with reference to FIG. 7 may be implemented via software stored on one or more non-transitory media.

According to this example, data from k physical microphones and data calculated for k virtual microphones that are co-located with the k physical microphones are added together. In other words, in this example the location of physical microphone 1 is the same as that of virtual microphone 1, the location of physical microphone 2 is the same as that of virtual microphone 2, etc., as shown in FIG. 6. However, in other examples there may be different numbers of physical microphones and virtual microphones. Moreover, in alternative examples the locations of the physical microphones and the virtual microphones may differ.

In some examples, a noise-reduction process may be applied to inputs from the k physical microphones before the summation process. The noise-reduction process may include any appropriate noise-reduction process known in the art, such as one of the noise-reduction process developed by Dolby.

According to some examples, gains may be applied to inputs from the k physical microphones and/or the k virtual microphones before the summation process. In the example shown in FIG. 7, a different gain function (Gaink) may be applied to each physical microphone's input. These gains may be applied, for example, in order to control the level of feedback and to keep feedback from getting out of control.

In this example, after the summation process the result is input to a reverb block. In this example, the reverb block involves a filtering process. The filtering process may involve applying a decay function in order to provide a desired shape for the decay of a particular reverberation effect. In many implementations, the filtering process may be frequency-dependent, in order to create a frequency-dependent decay. In some examples, the frequency-dependent decay may cause higher frequencies to decay faster. The filtering process may, in some examples, involve applying a low-pass filter. In some examples, the filtering process may involve separating early reflections from late reverberation.

In some examples, the filtering process may involve filtering, which may be recursive filtering, in the time domain. In some instances, the filtering process may involve applying one or more Feedback Delay Network (FDN) filters. Such methods generally produce an exponential decay profile, which works well for many environments (such as rooms).

However, relatively more complex decay functions may be provided by processing in the frequency domain. For example, in order to represent the reverb for an outdoor, urban environment, with reflections from individual buildings, an exponential decay profile would not be optimal. In such instances, a content creator might want to simulate, e.g., bursts of echoes from nearby buildings or groups of buildings. Filtering in the frequency domain provides more flexibility to customize reverb effects for simulating such environments. However, creating such effects may consume more processing resources. Accordingly, in some instances there may be a tradeoff between processing overhead versus realizing a content creator's artistic intent more accurately.

In some implementations, the filtering process may involve generating reverberation effects off-line and interpolating them at runtime according to the position of the sources and listener. Some such examples involve applying a block-based, Fourier-domain artificial reverberator. According to some examples, a noise sequence may first be weighted by a reverberation decay profile, which may be a real-valued reverberation decay profile, prior to complex multiplication with an input source signal (such as the summed virtual and physical microphone signals of FIG. 6). According to some such examples, several prior blocks of the input audio signal may have been processed in this manner and may be summed, along with the present block, in order to construct a frame of a reverberated audio signal. Some relevant examples are provided in Tsingos, *Pre-Computing Geometry-Based Reverberation Effects for Games*, (AES 35th International Conference, London, UK, 2009 Feb. 11-13), which is hereby incorporated by reference.

According to some implementations, such as the example shown in FIG. 6, the signals input to and output from a reverberation filtering process may be mono audio signals. In this example, the reverb block includes a panning process in order to produce multi-channel audio output from input mono audio data. In this example, the panning process produces m output signals, corresponding to m room speakers of a reproduction environment. According to this example, a decorrelation process is applied to the m output signals prior to output.

In some examples, the panning process may include an object-based renderer. According to some such examples, the object-based renderer may apply time-varying location metadata and/or size metadata to audio objects.

In some examples, such as shown in FIG. 7, gains are applied after the panning process. In the example shown in FIG. 7, the gains are $Gain_{k,m}$, indicating that the gains are a function of the distance between each microphone k and the speaker m for which the object is rendered. For example, applying the gain may involve providing a relatively lower gain for a room speaker having a closest room speaker location to the microphone location and providing relatively higher gains for room speakers having room speaker locations farther from the microphone location, e.g., as described above with reference to FIG. 6.

Figure 8:
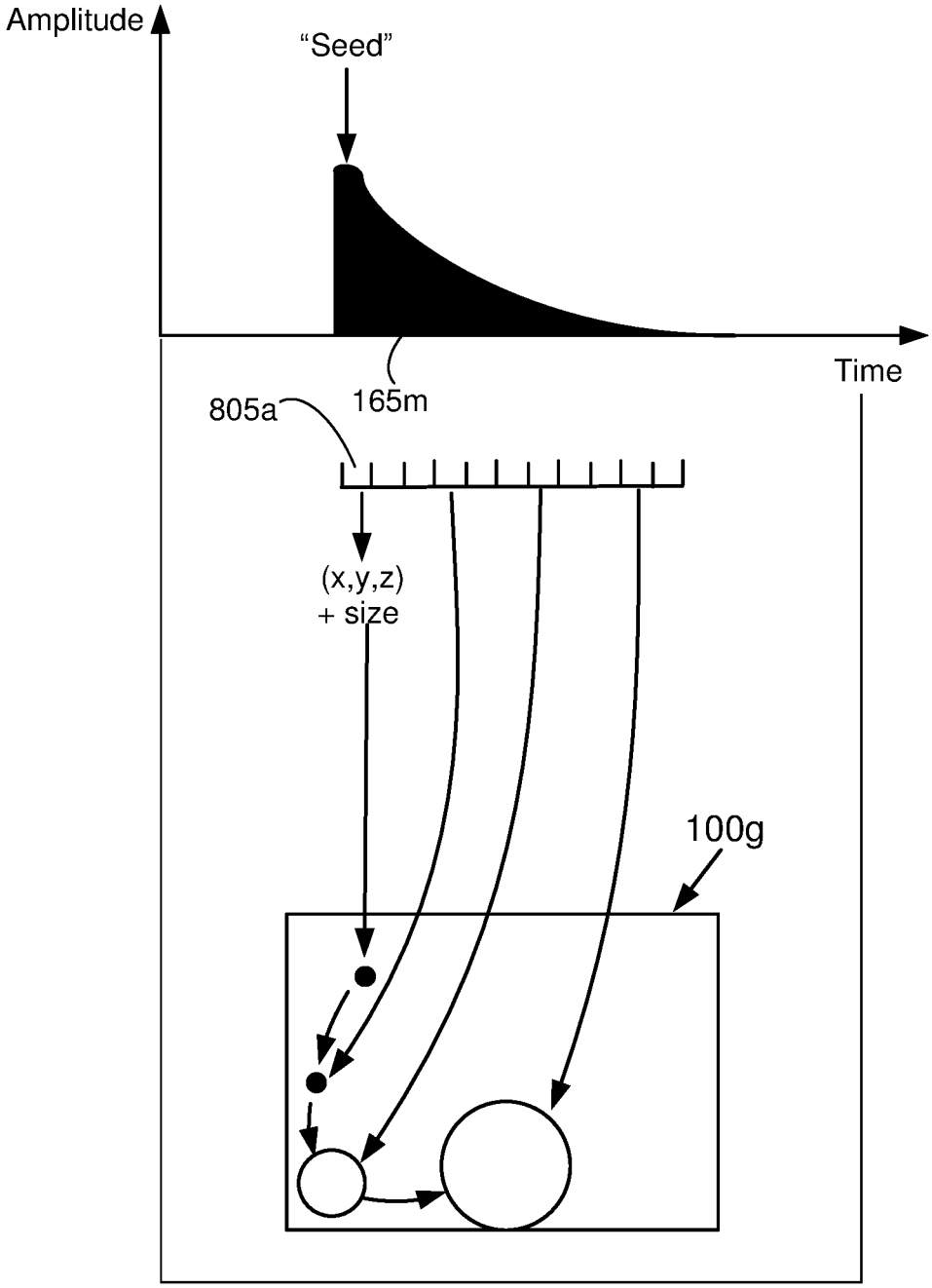
FIG. 8 illustrates one example of producing reverberant audio objects.

FIG. 8 illustrates one example of producing reverberant audio objects. In this example, an object-based renderer of a reverb block, such as the reverb block described above with reference to FIG. 7, has applied time-varying location metadata and size metadata to a reverberant audio object. Accordingly, the size of the audio object, as well as the position of the audio object within the reproduction environment 100*g*, changes as a function of time. According to this example, the amplitude of the reverberant audio object also changes as a function of time, according to the amplitude of the artificial reverberation 165*m* at the corresponding time interval. The characteristics of the artificial reverberation 165*m* during the time interval 805*a*, including but not limited to the amplitude, may be considered as a "seed" that can be modified for subsequent time intervals.

Various modifications to the implementations described in this disclosure may be readily apparent to those having ordinary skill in the art. For example, some scenarios being investigated by the Moving Picture Experts Group (MPEG) are six degrees of freedom virtual reality (6 DOF) which is exploring how a user can takes a "free view point and orientation in the virtual world" employing "self-motion" induced by an input controller or sensors or the like. (See 118th MPEG Hobart(TAS), Australia, 3-7 Apr. 2017, Meeting Report at Page 3) MPEG is exploring from an audio perspective scenarios which are very close to a gaming scenario where sound elements are typically stored as sound objects. In these scenarios, a user can move through a scene with 6 DOF where a renderer handles the appropriately processed sounds dependent on a position and orientation. Such 6 DOF employ pitch, yaw and roll in a Cartesian coordinate system and virtual sound sources populate the environment.

Sources may include rich metadata (e.g. sound directivity in addition to position), rendering of sound sources as well as "Dry" sound sources (e.g., distance, velocity treatment and environmental acoustic treatment, such as reverberation).

As described in in MPEG's technical report on Immersive media, VR and non-VR gaming applications sounds are typically stored locally in an uncompressed or weakly encoded form which might be exploited by the MPEG-H 3D Audio, for example, if certain sounds are delivered from a far end or are streamed from a server. Accordingly, rendering could be critical in terms of latency and far end sounds and local sounds would have to be rendered simultaneously by the audio renderer of the game.

Accordingly, MPEG is seeking a solution to deliver sound elements from an audio decoder (e.g., MPEG-H 3D) by means of an output interface to an audio renderer of the game.

Some innovative aspects of the present disclosure may be implemented as a solution to spatial alignment in a virtual environment. In particular, some innovative aspects of this disclosure could be implemented to support spatial alignment of audio objects in a 360-degree video. In one example supporting spatial alignment of audio objects with media played out in a virtual environment. In another example supporting the spatial alignment of an audio object from another user with video representation of that other user in the virtual environment.

The general principles defined herein may be applied to other implementations without departing from the scope of this disclosure. Thus, the claims are not intended to be limited to the implementations shown herein, but are to be accorded the widest scope consistent with this disclosure, the principles and the novel features disclosed herein.

What is claimed is:

1. An audio processing method, comprising:

receiving audio reproduction data, the audio reproduction data including audio objects;

differentiating near-field audio objects and far-field audio objects in the audio reproduction data, based on a location at which an audio object is to be rendered within a reproduction environment;

rendering the far-field audio objects into a first plurality of speaker feed signals for room speakers of a reproduction environment, each speaker feed signal of the first plurality of speaker feed signals corresponding to at least one of the room speakers;

rendering the near-field audio objects into a second plurality of speaker feed signals for at least one of near-field speakers or headphone speakers of the reproduction environment;

receiving physical microphone data from a plurality of physical microphones in the reproduction environment;

calculating virtual microphone data for one or more virtual microphones, the virtual microphone data corresponding to one or more of the near-field audio objects;

generating reverberant audio objects based, at least in part, on the physical microphone data and the virtual microphone data; and rendering the reverberant audio objects into a third plurality of speaker feed signals for the room speakers of the reproduction environment.

2. The method of claim 1, wherein the physical microphone data are based, at least in part, on sound produced by the room speakers.

3. The method of claim 1, wherein generating the reverberant audio objects involves applying a reverberant audio object gain, the reverberant audio object gain being based at least in part on a distance between a room speaker location and a physical microphone location or a virtual microphone location.

4. The method of claim 3, wherein applying the reverberant audio object gain involves providing a relatively lower gain for a room speaker having a closest room speaker location to the microphone location and providing relatively higher gains for room speakers having room speaker locations farther from the microphone location.

5. The method of claim 1, wherein generating the reverberant audio objects involves:

making a summation of the physical microphone data and the virtual microphone data; and providing the summation to a reverberation process.

6. The method of claim 5, further comprising applying a noise reduction process to at least the physical microphone data.

7. The method of claim 5, further comprising applying a gain to at least one of the physical microphone data or the virtual microphone data.

8. The method of claim 5, wherein the reverberation process comprises applying a filter to create a frequency-dependent amplitude decay.

9. The method of claim 1, wherein rendering the reverberant audio objects involves applying one or more of time-varying location metadata or size metadata.

10. The method of claim 1, further comprising decorrelating the reverberant audio objects.

11. The method of claim 1, further comprising:

receiving a reverberation indication associated with the audio reproduction data; and generating the reverberant audio objects based, at least in part, on the reverberation indication.

12. The method of claim 1, wherein differentiating the near-field audio objects and the far-field audio objects involves determining a distance between a location at which an audio object is to be rendered and a location of the reproduction environment.

13. One or more non-transitory media having software stored thereon, the software including instructions for performing the method of claim 1.

14. An apparatus, comprising:

an interface system configured for receiving audio reproduction data, the audio reproduction data including audio objects; and a control system configured for:

differentiating near-field audio objects and far-field audio objects in the audio reproduction data, based on a location at which an audio object is to be rendered within a reproduction environment;

rendering the far-field audio objects into a first plurality of speaker feed signals for room speakers of a reproduction environment, each speaker feed signal of the first plurality of speaker feed signals corresponding to at least one of the room speakers;

rendering the near-field audio objects into a second plurality of speaker feed signals for at least one of near-field speakers or headphone speakers of the reproduction environment;

receiving, via the interface system, physical microphone data from a plurality of physical microphones in the reproduction environment;

calculating virtual microphone data for one or more virtual microphones, the virtual microphone data corresponding to one or more of the near-field audio objects;

generating reverberant audio objects based, at least in part, on the physical microphone data and the virtual microphone data; and rendering the reverberant audio objects into a third plurality of speaker feed signals for the room speakers of the reproduction environment.

15. The apparatus of claim 14, wherein the physical microphone data are based, at least in part, on sound produced by the room speakers.

16. The apparatus of claim 14, wherein generating the reverberant audio objects involves applying a reverberant audio object gain, the reverberant audio object gain being based at least in part on a distance between a room speaker location and a physical microphone location or a virtual microphone location.

17. The apparatus of claim 16, wherein applying the reverberant audio object gain involves providing a relatively lower gain for a room speaker having a closest room speaker location to the microphone location and providing relatively higher gains for room speakers having room speaker locations farther from the microphone location.

18. The apparatus of claim 14, wherein generating the reverberant audio objects involves:

making a summation of the physical microphone data and the virtual microphone data; and providing the summation to a reverberation process.

19. The apparatus of claim 18, wherein the control system is configured for applying a noise reduction process to at least the physical microphone data.

20. The apparatus of claim 18, wherein the control system is configured for applying a gain to at least one of the physical microphone data or the virtual microphone data.

21. The apparatus of claim 18, wherein the reverberation process comprises applying a filter to create a frequency-dependent amplitude decay.

22. The apparatus of claim 14, wherein rendering the reverberant audio objects involves applying one or more of time-varying location metadata or size metadata.

23. The apparatus of claim 14, wherein the control system is configured for decorrelating the reverberant audio objects.

24. The apparatus of claim 14, wherein the control system is configured for:

receiving, via the interface system, a reverberation indication associated with the audio reproduction data; and generating the reverberant audio objects based, at least in part, on the reverberation indication.

25. The apparatus of claim 24, wherein the reverberation indication indicates a reverberation that corresponds with a virtual environment of a game.

26. The apparatus of claim 14, wherein differentiating the near-field audio objects and the far-field audio objects involves determining a distance between a location at which an audio object is to be rendered and a location of the reproduction environment.

* * * * *